US008707579B2

(12) United States Patent
Kohlrusch et al.

(10) Patent No.: US 8,707,579 B2
(45) Date of Patent: Apr. 29, 2014

(54) METHOD FOR OPERATING AN ADSORPTION DRYER AND DRYER FOR IMPLEMENTING THE METHOD

(75) Inventors: Frank Kohlrusch, Berlin (DE); Ulf Müller, München (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 282 days.

(21) Appl. No.: 13/391,649

(22) PCT Filed: Aug. 16, 2010

(86) PCT No.: PCT/EP2010/061887

§ 371 (c)(1),
(2), (4) Date: Feb. 22, 2012

(87) PCT Pub. No.: WO2011/023580

PCT Pub. Date: Mar. 3, 2011

(65) Prior Publication Data

US 2012/0144691 A1 Jun. 14, 2012

(30) Foreign Application Priority Data

Aug. 27, 2009 (DE) ..... 10 2009 028 931

(51) Int. Cl.
*F26B 21/00* (2006.01)

(52) U.S. Cl.
USPC ..... 34/381; 34/472; 34/73; 34/595; 34/610; 68/5 R; 68/19; 8/111

(58) Field of Classification Search
USPC ..... 34/381, 385, 472, 595, 73, 601, 606, 34/610; 68/5 C, 5 R, 19, 20; 8/111, 149, 8/159
See application file for complete search history.

(56) References Cited

U.S. PATENT DOCUMENTS 2,499,328 A 2/1950 Pawlansky
3,095,284 A * 6/1963 Victor ..... 34/473

(Continued)

FOREIGN PATENT DOCUMENTS

DE 3626887 A1 2/1988
EP 0777998 A1 6/1997

(Continued)

OTHER PUBLICATIONS

International Search Report PCT/EP2010/061887, dated Feb. 17, 2011.

(Continued)

*Primary Examiner* — Steve M Gravini
(74) *Attorney, Agent, or Firm* — James E. Howard; Andre Pallapies

(57) ABSTRACT

In a method for operating an adsorption dryer, a process air flow, generated by at least one blower, is routed at least at times through an adsorption apparatus and over a textile goods in care during a textile care process in a "dry" operating mode to thereby charge a reversibly dehydratable adsorbent of the adsorption apparatus with moisture. A charge state of the adsorbent with water is detected and is displayed at least after the end of the "drying" textile care process. The absorbent is desorbed at least in part during a subsequent, selected and started textile care process in a "refresh" operating mode, and the desorbed moisture is routed as a moist process air flow into a receptacle for refreshing textile goods which are stored or hung in a stationary manner.

18 Claims, 2 Drawing Sheets

(56) References Cited

U.S. PATENT DOCUMENTS

| | | | | |
|---|---|---|---|---|
| 3,134,652 | A * | 5/1964 | D'Angelo et al. | 34/77 |
| 5,123,176 | A * | 6/1992 | Yamada et al. | 34/467 |
| 5,752,323 | A * | 5/1998 | Hashimoto et al. | 34/80 |
| 2003/0000106 | A1 * | 1/2003 | Anderson et al. | 34/598 |
| 2004/0045187 | A1 | 3/2004 | Curry et al. | |
| 2005/0016010 | A1 * | 1/2005 | Pyo et al. | 34/62 |
| 2008/0149142 | A1 | 6/2008 | Jerg et al. | |
| 2009/0064531 | A1 | 3/2009 | Moon et al. | |
| 2009/0126423 | A1 | 5/2009 | Bae et al. | |
| 2012/0144691 | A1 * | 6/2012 | Kohlrusch et al. | 34/473 |
| 2013/0269207 | A1 * | 10/2013 | Grunewald | 34/472 |
| 2013/0305553 | A1 * | 11/2013 | Heo et al. | 34/86 |

FOREIGN PATENT DOCUMENTS

| | | | | |
|---|---|---|---|---|
| EP | 1541741 | A2 * | 6/2005 | D06F 58/04 |
| GB | 2024387 | A * | 1/1980 | F26B 21/08 |
| GB | 2284164 | A | 5/1995 | |
| JP | 9135995 | A | 5/1997 | |
| JP | 2002062047 | A | 2/2002 | |
| JP | 2011182861 | A * | 9/2011 | |
| WO | 2009020313 | A2 | 2/2009 | |

OTHER PUBLICATIONS

National Search Report DE 10 2009 028 931.3, dated May 6, 2010.

* cited by examiner

METHOD FOR OPERATING AN ADSORPTION DRYER AND DRYER FOR IMPLEMENTING THE METHOD

BACKGROUND OF THE INVENTION

The invention relates to a method for operating an adsorption dryer, in particular a drying cabinet, and such a dryer comprising a receptacle for textile goods which are stored or hung in a stationary manner, a guide for the dry air flow, a heater, an adsorption apparatus having a reversibly dehydratable adsorbent, and at least one blower for generating an air flow, wherein said air flow is routed over the heater, the textile goods to be treated and through the adsorption apparatus.

A device in which the moisture is removed from moisture-enriched air by means of an adsorbent drying agent (adsorbent) is disclosed in the unexamined German application DE 36 26 887 A1. The device claimed in said application, being designed as a clothes dryer, comprises a receptacle container for the goods to be dried, a blower which advances the process air in the closed circuit, a heater unit for heating the process air, and a container for holding a storage medium that works by adsorbing and desorbing water. In the cited unexamined German application, a material based on zeolite is proposed as such a reversibly adsorbing storage medium.

The dryer is operated in such a way that the process air is heated at the beginning of the drying process in order to achieve a suitable operating temperature. As the adsorbent dehumidification by the adsorber becomes effective and the adsorption heat is released accordingly, the supplied heating power is considerably reduced.

The adsorber is arranged in a container in such a way that the air flow for dehumidification and the air flow for desorption of the adsorber can be guided over said adsorber alternately. An additional air guiding system and suitable air guiding control means, in particular control gates, and an additional heater for heating the desorbing air flow are provided for the air flow that is used for desorption of the adsorber.

Also known is an adsorption dryer in which the dry air flow in the closed circuit is guided in opposite directions alternately during the drying process. By virtue of the two-way through-flow, the goods to be dried are more uniformly exposed to the flow or through-flow of the process air, and the time that is required to achieve a desired drying result can be shortened.

The adsorption dryers can be operated very effectively in that the heat energy which is expended during the dehumidification of the goods to be dried can be released and fed back into the process air during adsorption of the moisture by the adsorbent. During the drying process, the adsorbent is used both for dehumidification of the goods to be dried and for heat recovery.

The unexamined Japanese application JP 09-135995 A discloses an adsorption dryer comprising a receptacle for textile goods, a first blower in a first flow channel and a second blower in a second flow channel, an adsorption apparatus comprising a reversibly dehydratable adsorbent and a heater for the desorption thereof. The adsorption dryer performs a textile care process in the "dry" operating mode, at the start of which an automatic decreasing program for removing creases is provided. In this case, ambient air is routed along the first flow channel over the adsorbent, until said adsorbent is sufficiently charged with moisture. As a result of switching on the heater, the adsorbent is then desorbed and the reemerging (desorbed) moisture is routed as steam into the receptacle and over the textile goods in order to remove creases. For the purpose of subsequently drying the de-creased textile goods, ambient air is routed over the adsorbent and into the receptacle. The moisture that then collects in the adsorbent can be removed periodically by switching on the heater and redirecting the process air flow, wherein ambient air that is heated by the heater is guided over the adsorbent and through a cooled heat exchanger, such that the steam emerging from the adsorbent can condense out at the heat exchanger.

The known adsorption dryers have the disadvantage that, following a drying process, the adsorbent has to be desorbed in order to ensure the subsequent operational readiness. The water vapor that is generated in this way must be removed, as condensation from a collection container or directly into the space surrounding the device. The energy that has to be expended during the desorption is comparatively high, whereby the operating costs of such a dryer disadvantageously increase.

BRIEF SUMMARY OF THE INVENTION

The object underlying the present invention is to configure and operate the adsorption dryer such that its use is more economical overall. According to the invention, the reconfiguration of the dryer can be achieved at very little additional expense. A solution that is as simple as possible is proposed for the technical realization of the object of the invention.

The object of the invention is also to display suitable information for the user, wherein said information is generated by the internal analysis system of the dryer and relates to the operating state of the dryer, allowing the user positively to influence the effectiveness of the dryer use by organizing the work cycles in an advantageous manner.

The invention has the advantage that use of the adsorption dryer is considerably more efficient in comparison with known dryers. This increase in efficiency is achieved by configuring the technical embodiment and the dryer controls such that the dryer can also be used as a "refresher".

Essential to the invention is that the energy expended for desorption of the adsorbent is at least partly used for the refresh function of the adsorption dryer. According to the invention, the energy that must be expended in any case for desorption of the adsorbent is utilized for an additional laundry care process. Both the diversity of use and the operational efficiency of the dryer are advantageously increased as a result of applying the invention.

Only modest technical effort is required to allow additional use of the dryer for the purpose of refreshing. In addition to the functional parts and component groups that already exist for the dryer operation, a switch or an additional switch setting of the operating switch is required in order to allow switching from dryer operation to the "refresh" operating mode. In order to avoid operator error, it is advantageous to display the selected operating mode to the user in a suitable and easily visible manner. Also required is an external water supply or an additional water reservoir, via which water can be supplied to the work process whenever the moisture content in the process air flow and required for the refresh function can no longer be generated by desorbing the adsorbent.

Furthermore, the dryer can have a user-accessible store for water-soluble additives such as softeners, for example. The additional store is connected to the water store or directly to the adsorber.

In order that the user can personally influence the operation of the device with regard to its effective utilization, the current charge state of the adsorbent, i.e. the extent to which the adsorbent is charged with water, is displayed to the user in an embodiment of the invention. On the basis of the information that is provided, the user can decide whether the residual holding capacity of the adsorbent is sufficient for a drying process or whether a work cycle for refreshing textile goods is more suitable. The information is derived from measurement data which has been captured using sensors and from which it is possible to determine the quantity of water held by the adsorbent.

BRIEF DESCRIPTION OF THE DRAWINGS

Further embodiments and advantages of the invention are derived from the following description of an exemplary embodiment. The exemplary embodiment is explained in further detail below with reference to the drawings, in which.

DETAILED DESCRIPTION OF EXEMPLARY EMBODIMENTS OF THE PRESENT INVENTION

Figure 1:
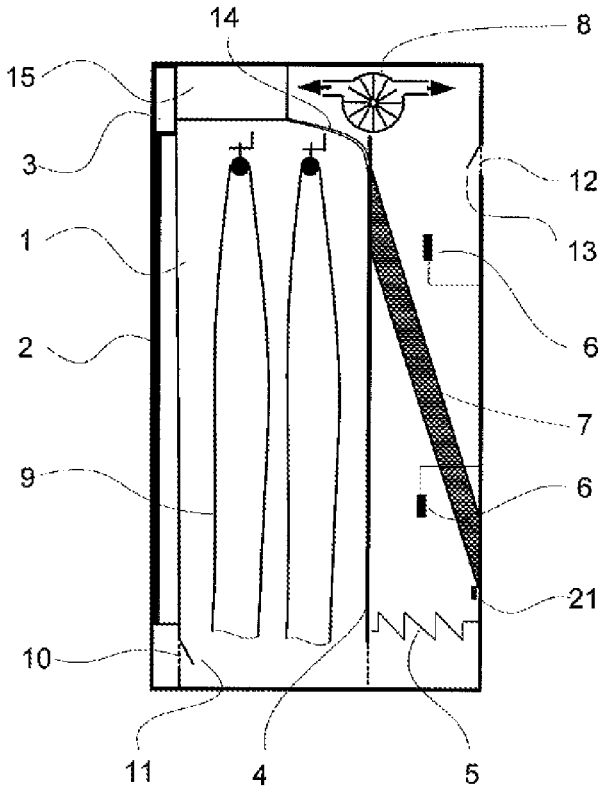
FIG. 1: shows a side view of an adsorption dryer in a sectional representation.
Figure 2:
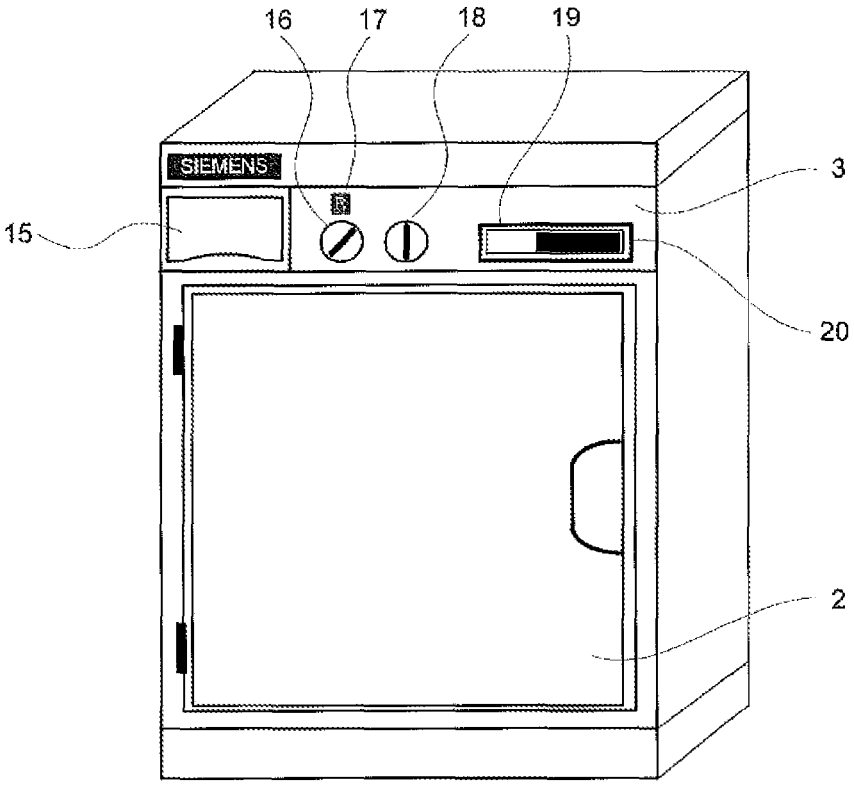
FIG. 2: shows a front view of the dryer.

FIG. 1 shows an adsorption laundry dryer in a side view, and FIG. 2 in a front view. Neither drawing illustrates details that are not directly relevant to the following explanation.

The textile goods 9 to be treated are suspended in the drying compartment 1, which can be loaded by the user via the door 2, this having lateral hinges. The drying compartment 1 and the adsorption apparatus 7 are separated by a partition 4, which has passages at top and bottom for the process air flow. The adsorption apparatus 7 is arranged in a spatially oblique manner and is suspended so as to be vertically mobile. As an adsorbent, the adsorption entity contains a zeolite packing, whose mass is configured in relation to the maximal quantity of goods to be dried 9. The adsorption entity 7 is actively connected to a pressure sensor 21, whose output signals are supplied to an intelligent analysis system for the purpose of determining the charge state of the zeolite.

The heater 5 is arranged beneath the adsorption entity 7, also referred to more concisely as an adsorber in the following. By means of this heater 5, the process air is heated up to the operating temperature that is required for the process. The desorbing process and hence the moisture content of the process air flow are essentially determined by the temperature and the flow speed of the process air that is guided in the circuit.

A cross-flow blower 8 having straight blades and a symmetrical housing is provided for the purpose of generating the air flow. Such a cross-flow blower 8 allows equally strong air flows to be generated in opposite directions by reversing the rotational direction of the fan wheel.

Fresh air from the exterior can be sucked in via an air supply opening 10 in the lower region of the dryer, while heated and moisture-charged air can be output to the exterior via an outgoing air opening 12 in the upper region of the dryer. Both air openings 10, 12 can be closed by means of controllable gates 11, 13. By virtue of the controllable gates 11, 13, the process parameters of the process air flow, temperature and moisture content, can quickly be lowered significantly.

For the purpose of monitoring and controlling the textile care process, two temperature sensors 6 whose output signals are supplied to an intelligent analysis system (not shown) are arranged symmetrically relative to the adsorber 7.

An external water store 15 that is easily accessible for the user is arranged adjacent to the operating panel 3. The water store 15 is designed as a drawer. The water store is connected to the adsorber 7 via a water transport line 14 having a control valve.

The dryer is activated by means of the rotating switch 16. The same switch 16 is used for selecting the "dry" and/or "refresh" operating mode. The selected operating mode is displayed to the user. Depending on the selection, a "D" or an "R" is illuminated in a function panel 17 above the switch 16 in the operating panel 3. Operator errors can be avoided by virtue of such an easily recognizable display 17.

The adaptation of the operating parameters to the textile goods 9 to be treated is effected by means of the same selection switch 18 as is used when drying. This preselection of settings allows the user to specify the temperature range for the laundry care process and the moisture content of the process air flow.

The operating panel 3 also comprises a display 19, which is easily visible to the user and provides the user with information relating to the charge state of the zeolite. In the exemplary embodiment, an illuminated bar 20 can be seen in the display 19. The bar 20 increases in length from right to left as the zeolite becomes increasingly charged with water.

In the context of the refresh function, the process air is heated by the heater unit 5 to a predefined temperature, this being determined by the user in the setting of the selection switch 18 to a specific material type, and is routed through the adsorber 7 by means of the blower 8. Moisture from the adsorber 7 passes into the air flow. This is associated with a drop in the temperature of the process air flow that is carried in the circuit. The moisture-enriched cooled process air arrives at the textile goods 9, which take up some of the moisture. As a result of this process, adsorption heat is released again, entering and reheating the process air flow. The heated process air is then carried back to the adsorber 7.

The pressure sensor 21 detects the amount of water being held by the absorber (zeolite) 7. The measurement data is analyzed internally within the device and displayed. The bar display 20 is provided for this purpose in the example. The bar display 20 provides the user with information relating to the extent to which the adsorber is saturated with liquid. In the case of the exemplary operating state that is illustrated in FIG. 2, 60% of the maximal liquid holding capacity of the zeolite is occupied.

The bar display 20 is one of many possible variants for indicating the charge level of the zeolite to the user. For example, a recommendation to operate the dryer could also be output in text format via a display.

The bar display in FIG. 2 shows an operating state in which the zeolite can only hold another 40% relative to its maximal capacity. In the event of such an operating state, it is not optimal to start a drying process which has a significant charge quantity. Under such circumstances, the drying process would take longer because the zeolite would have to be at least partly desorbed in one or more intermediate steps during the drying process. It is more advantageous, because it is more economical overall in terms of energy, to use the dryer for its refresh function if the zeolite has a high charge level.

The user is at liberty to operate the dryer according to the information that is displayed. The display 19, indicating the charge level of the zeolite in terms of water, provides the user with the information that is required to organize the operation of the dryer effectively.

The temperature of the process air is reduced as a result of the amount of moisture that is released by the zeolite. The temperature of the process air flow is captured on both sides of the adsorber 7 by means of the sensors 6. The temperature difference is a measure of the amount of moisture released during the desorption of the zeolite. If the temperature difference drops significantly, the desorption of the zeolite is largely complete. If the refresh function is not yet complete in this operating state, additional water is supplied to the adsorber from the water container 15.

If the care process is operated in an intermittent manner, the temperature of the process air and hence its moisture content are briefly increased during the refresh function. The subsequent sharp drop in the temperature of the process air flow and its moisture content is controlled by the outgoing air line and/or incoming air line 10, 12, which can be opened by means of the two controllable gates 11, 13. When the process is operated in this way, the operating parameters are sharply adjusted during a brief period, and the desorption of the zeolite is accelerated at the same time.

LIST OF REFERENCE NUMBERS

1. Drying compartment
2. Door
3. Operating panel
4. Partition
5. Heater
6. Sensors
7. Adsorber
8. Blower
9. Textile goods
10. Incoming air opening
11. Incoming air gate
12. Outgoing air opening
13. Outgoing air gate
14. Liquid transport line
15. Water container
16. Rotating switch
17. Function display
18. Selection switch
19. Charge indicator
20. Illuminated bar
21. Pressure sensor

The invention claimed is:

1. A method for operating an adsorption dryer, comprising:
routing a process air flow, generated by at least one blower, at least at times through an adsorption apparatus and over a textile goods in care during a textile care process in a "dry" operating mode; thereby charging a reversibly dehydratable adsorbent of the adsorption apparatus with moisture;
detecting a charge state of the adsorbent with water;
displaying "dry" at least after conclusion of the textile care process;
desorbing the absorbent at least in part during a subsequent, selected and started textile care process in a "refresh" operating mode; and
routing desorbed moisture as a moist process air flow into a receptacle for refreshing textile goods which are stored or hung in a stationary manner.

2. The method of claim 1, further comprising controlling and/or adjusting at least one process parameter selected from the group consisting of temperature, moisture content and flow speed of the process air flow during at least one of the two textile care processes.

3. The method of claim 1, further comprising controlling a temperature and moisture content of the process air flow via an outgoing air opening and an incoming air opening.

4. The method of claim 1, further comprising controlling and/or adjusting at least one of the two textile care processes according to a preselection of settings relating to a type of the textile goods.

5. The method of claim 1, further comprising metrologically capturing process parameters that are critical to the textile care process in the "refresh" operating mode by sensors, and supplying captured measurement data to an intelligent analysis system for internal analysis.

6. The method of claim 5, wherein the process parameters are temperature and moisture content of the process air flow.

7. The method of claim 1, further comprising supplying water to the adsorbent in the adsorption apparatus when a saturation level of the adsorbent is insufficient for required humidification of the process air flow during the textile care process in the "refresh" operating mode.

8. The method of claim 1, further comprising supplying a water-soluble additive to the process air flow during the textile care process in the "refresh" operating mode.

9. The method of claim 8, wherein the water-soluble additive is a softener.

10. An adsorption dryer, comprising
a receptacle for textile goods;
at least one blower for generating a process air flow;
an adsorption apparatus having a reversibly dehydratable adsorbent;
a heater for desorption of the absorbent to enable moisture desorbed from the adsorbent to be routed into the receptacle for refreshing the textile goods;
at least one sensor for detecting a charge state of the adsorbent with water;
a first display for indicating the charge state of the adsorbent with water; and
a selection switch which allows selection and starting of at least one textile care process in a "dry" operating mode and selection and starting of a textile care process in a "refresh" operating mode,
wherein after completion of the textile care process in the "dry" operating mode, the heater for desorbing the adsorbent is activatable during a subsequently selectable textile care process in the "refresh" operating mode.

11. The adsorption dryer of claim 10, further comprising an operating panel which includes the first display and a second display, said second display indicating an operating mode of the selected textile care process.

12. The adsorption dryer of claim 10, further comprising at least one member selected from the group consisting of water store and interface to an external water supply network, said member being connected via a water transport line to the adsorption apparatus or directly to the adsorbent.

13. The adsorption dryer of claim 12, further comprising a control valve arranged in the water transport line.

14. The adsorption dryer of claim 12, further comprising an operating panel which includes the first display, said water store being designed as a drawer and arranged in a region of the operating panel.

15. The adsorption dryer of claim 12, further comprising an additional store for water-soluble additives, said additional store being connected to the water store or directly connected to the adsorption apparatus for releasing the additives.

16. The adsorption dryer of claim 15, wherein the water-soluble additive is a softener.

17. The adsorption dryer of claim 10, wherein the sensor for detecting the charge state of the adsorbent is a pressure sensor.

18. The adsorption dryer of claim 10, wherein the receptacle has at least one outgoing air opening and one incoming air opening, further comprising a first controllable gate for closing the outgoing air opening, and a second controllable gate for closing the incoming air opening.

* * * * *